US010202262B2

(12) United States Patent
Willim et al.

(10) Patent No.: US 10,202,262 B2
(45) Date of Patent: Feb. 12, 2019

(54) METHOD OF OPERATING A CRANE, AND CRANE

(71) Applicant: Liebherr-Werk Ehingen GmbH, Ehingen-Donau (DE)

(72) Inventors: Hans-Dieter Willim, Ulm-Unterweiler (DE); Uwe Frommelt, Ehingen (DE); Jens Koenneker, Munderkingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 291 days.

(21) Appl. No.: 15/151,434

(22) Filed: May 10, 2016

(65) Prior Publication Data

US 2016/0332850 A1 Nov. 17, 2016

(30) Foreign Application Priority Data

May 11, 2015 (DE) ..... 10 2015 006 117

(51) Int. Cl.
*B66C 23/76* (2006.01)

(52) U.S. Cl.
CPC ..... *B66C 23/76* (2013.01)

(58) Field of Classification Search
CPC ..... B66C 23/76; B66C 23/74; B66C 23/72
See application file for complete search history.

(56) References Cited

U.S. PATENT DOCUMENTS

| | | | | |
|---|---|---|---|---|
| 3,955,684 | A * | 5/1976 | Novotny | B66C 23/36 212/178 |
| 4,108,317 | A * | 8/1978 | Bifani | B66C 23/74 212/195 |
| 7,213,716 | B2 | 5/2007 | Willim et al. | |
| 7,967,158 | B2 * | 6/2011 | Pech | B66C 23/76 212/178 |
| 9,278,834 | B2 * | 3/2016 | Pech | B66C 23/76 |
| 2005/0061761 | A1 * | 3/2005 | Willim | B66C 23/74 212/178 |
| 2005/0284834 | A1 | 12/2005 | Willim | |
| 2016/0052755 | A1 | 2/2016 | Willim | |

FOREIGN PATENT DOCUMENTS

| | | | | |
|---|---|---|---|---|
| CN | 202449769 | U | 9/2012 | |
| DE | 2254074 | A1 | 5/1974 | |
| DE | 29607257 | U1 | 7/1996 | |
| DE | 19832746 | A1 | 1/2000 | |
| DE | 20314503 | U1 | 3/2005 | |
| DE | 202004009497 | U1 | 11/2005 | |
| DE | 102007028778 | A1 | 1/2008 | |
| DE | 102011105960 | A1 | 1/2013 | |
| DE | 102012002040 | A1 * | 8/2013 | B66C 23/76 |
| DE | 102013103999 | A1 | 10/2013 | |
| DE | 102014012661 | A1 | 2/2016 | |
| EP | 2308792 | A1 | 4/2011 | |

* cited by examiner

*Primary Examiner* — Emmanuel M Marcelo
(74) *Attorney, Agent, or Firm* — McCoy Russell LLP

(57) ABSTRACT

A crane may include a travelable undercarriage, a superstructure rotatably supported thereon with a luffable boom system arranged thereon and a derrick boom, with an auxiliary crane being used as derrick ballast. In The auxiliary crane may be driven onto a ballast base plate attached to the derrick boom for the alignment of the boom system in order to thus form at least a large portion of the counterweight.

18 Claims, 12 Drawing Sheets

METHOD OF OPERATING A CRANE, AND CRANE

CROSS REFERENCE TO RELATED APPLICATION

This application claims priority to German Patent Application No. 10 2015 006 117.8, entitled "Method of Operating a Crane, and Crane," filed on May 11, 2015, the entire contents of which is hereby incorporated by reference in its entirety for all purposes.

TECHNICAL FIELD

The present disclosure relates to a method of operating a crane having a movable undercarriage, having a superstructure rotatably supported thereon and with a boom system arranged luffably thereat, and having a derrick boom.

BACKGROUND AND SUMMARY

Large cranes, in particular large crawler-mounted cranes, require a considerable counter-weight which counteracts the raised payload and prevents the tilting of the crane. This counter-weight can be applied by a central ballast, by a superstructure ballast or also by a ballast at the derrick boom. As a rule, a ballast plate supported with respect to the ground via corresponding auxiliary means to take up the ballast is proposed as a possible derrick ballast. A completely suspended ballast or also a derrick ballast carried by a ballast box is possible as an alternative.

Against this background, special ballast boxes have been developed which are designed as independently driven vehicles and can therefore be moved together with the crane to ensure a largely unrestricted crane operation. Such solutions, however, always require a complex separate development of a suitable ballast box which is used only for the ballast application. Furthermore, such a ballast box has to be transported separately onto the construction site for the crane use, which has a disadvantageous effect on the deployment costs incurred since they depend as a rule on the required ballast mass.

DE 10 2011 105 960 A1 describes connecting an auxiliary crane having a telescopic boom as a derrick ballast to a crane. This ballast application possibility can be used, for example, during regular crane deployment or during the crane equipping process, especially during the erection process of the luffable boom system. A comparatively small crane required for the equipping procedure of the large crawler-mounted crane can be used as the auxiliary crane, for example.

It has furthermore has been proposed in the non-prepublished DE 10 2014 012 661 A1 to use an auxiliary crane as a ballast box having an additional added suspended ballast.

It must, however, be considered that a lattice crane with suspended ballast has to observe a plurality of failure criteria. It is thus clear that a tilting of the total crane to the rear beyond the tilting edge, that is beyond the end of the footprint on the ground, has to be prevented. This can take place via the monitoring of the overall center of gravity.

A further feature is the prevention of an uncontrolled pivoting of a boom element to the rear about its lulling axis. The main boom, e.g. the boom system, or the derrick boom, can be boom elements. Securities against fall-back admittedly counteract this effect, but their performance capability is limited. The crane statics must also be considered for the case of a "breaking away of the load". The crane may not tilt to the rear in this case.

A further aspect for the design of the crane is a space requirement which is as small as possible on the construction site. A very large number of transportation trucks are thus in use on construction sites, in particular construction sites for assembling wind power stations. They have to move very close to the crane in order to keep the outreach of the crane small when taking up the loads. Some solutions have already been put forward for these problems. DE 296 07 257 U1 thus shows a crane having a gate-shaped undercarriage. A truck can drive through this gate-shaped undercarriage. DE 10 2007 028 778 A1 furthermore shows a crane having a connection between the superstructure and the ballast box which is disposed higher and likewise allows a driving through of a truck.

Finally, it has been proposed in EP 2 308 792 A1 for the prevention of a state in which the crane tilts to the rear or is pulled to the rear by the suspended ballast that a triangular derrick very greatly reduces the spacing in the direction of the longitudinal axis of the superstructure between the axis of the superstructure and the suspended ballast. A very high derrick ballast is attached in this solution in order thus to be able to reduce the derrick ballast radius.

The aforesaid solutions each have different advantages and disadvantages.

The solution in accordance with DE 10 2011 105 960 A1 thus has the advantage that a small crane present on the construction site can be used as derrick ballast so that no separate ballast box has to be kept available. On the other hand, the coupling mechanism of this auxiliary crane with the crane to have ballast attached is comparatively complex so that a complex use of the auxiliary crane is provided which has a large dismantling effort.

It is thus the object of the present disclosure to provide a method of operating a crane and a corresponding crane which provides the counter-ballast which is required for the different load states during the erection of the crane, on the one hand, but also allows operation of the crane fast and in a simple manner and with means which are as simple as possible.

This object may be achieved by a crane having a travelable undercarriage, a superstructure rotatably supported thereon and a luffable boom system arranged thereon, and a derrick boom, in which an auxiliary crane is used as derrick ballast. The auxiliary crane may be moved onto a ballast base plate attached to the derrick boom on the erection of the boom system, on which a very large counter-torque therefore may be applied, in order thus to form at least a large portion of the counter-weight.

The derrick ballast can thus be provided with ballast fast and simply. Instead of a complex stacking up of ballast plates to the height of the mass of the in-moving auxiliary crane, the auxiliary crane can drive onto the ballast base plate in a very simple and fast manner in order thus to form the corresponding derrick ballast. In this respect, the auxiliary crane also no longer has to be fastened to an adapter, which has to be provided accordingly, at the superstructure of the crane to be ballast loaded. This substantially simplifies the assembly and the dismantling and allows a substantially more flexible use of the auxiliary crane. This high derrick weight is thus frequently only required during the erection of the boom system since a particularly high counter-torque has to be applied here. After a corresponding erection of the boom system, the auxiliary crane can then again be traveled off the ballast base plate.

At least one counter-weight stack of counter-weight plates can additionally be stacked on the ballast base plate. The counter-weight plates can here be divided over different weight stacks to achieve a uniform distribution of the weight on the counter-weight plate.

At least one guying can be arranged between the derrick boom and the ballast base plate such that the stay poles are guided from the derrick boom, optionally with an interposition of length-variable cylinder arrangements, to a cross-brace, which together with lateral connection blocks, which serve for connecting the cross-brace to the ballast base plate, forms a kind of gate into which the auxiliary crane can drive.

The inclination of the ballast base plate can furthermore be detected via at least one inclination sensor, with the recorded inclination values being detected and monitored via a control the crane so that, if required, the inclination of the ballast base plate is returned into a desired range via the cylinder arrangement.

It can furthermore be determined via a sensor device whether the ballast base plate has been completely raised from the ground. This measured state value is advantageously likewise forwarded to the control (e.g., so that the control may prompt an operator of the crane via a display device or other means to add additional ballast if the ballast base plate has been completely raised from the ground).

The spacing between the ballast base plate and the superstructure of the crane can advantageously be determinable via a guide frame arranged between them to generate a comparatively larger ballast torque.

It is particularly advantageous that, after a corresponding erection of the boom system or after another crane operation in which a very large counter-ballast has to be provided, the ballast, which at least comprises the ballast base plate with the ballast located thereon, is decoupled from the crane via releasable connections, optionally via pin connections arranged between the cross-brace and the connection blocks, for the subsequent travel or rotation of the crane. After a corresponding decoupling of the ballast base plate with the ballast located thereon, the crane can be traveled or rotated without problem. This is therefore possible since the crane substantially no longer requires such a high counter-torque during the travel and rotation. The application of ballast by the central ballast is frequently sufficient for this state.

The method is advantageously further developed in that, after decoupling the ballast which is attached at the derrick boom and which at least comprises the ballast base plate with the ballast located thereon, if required, counter-stacking plates are received in a suspended manner at the cross-brace attached to the derrick boom or directly via corresponding connection apparatuses in order thus to form a constant ballast attached to the derrick boom. Such a constant ballast is sufficient to achieve the required payload, for example, for the assembly of the elements of plants, for example of wind power stations, when here in particular the maximum ballast load of the main crane with central ballast and superstructure ballast is not sufficient.

This constant ballast can advantageously be taken up via the connection means of the counter-weight plates, as required, directly from the decoupled ballast base plate of the ballast. In this alternative embodiment, there may no longer be any need for the attached cross-brace of the previously described embodiment variant.

Special payload tables are advantageously integrated in the crane control which can be selected for the case of the attached constant ballast, with this ensuring that the crane reliably actually does not tilt to the rear with an advantageously luffed boom system.

The method is particularly advantageously configured, in particular for the erection of the boom system, in that counter-weight plates are directly removed from the superstructure ballast and are stacked on the ballast base plate to increase the torque. The counter-weight plates are hereby therefore no longer active as superstructure ballast, but rather as derrick ballast and increase the torque without additional counter-weight plates here having to be transported in or away again later.

In one embodiment of the present disclosure, a crane may comprise a movable undercarriage, a superstructure rotatably supported thereon with a luffable boom system arranged thereon and a derrick boom and with a crane control. It is characterized in that it has a ballast apparatus as derrick ballast which at least comprises a ballast base plate for receiving an auxiliary crane, wherein they are connected via lateral connection blocks to a cross-brace such that a gate is formed into which the auxiliary crane can drive, with the cross-brace in turn being connected via stay poles to the derrick boom.

Respective length-variable elements in the form of hydraulic cylinder arrangements can advantageously be provided between the derrick boom and the cross-brace.

At least one counter-weight stack comprising counter-weight plates can additionally be stacked on the ballast base plate.

Releasable connections can advantageously be arranged between the cross-brace and the connection blocks. The total ballast base plate with the ballast located thereon can hereby be decoupled in a simple manner.

In accordance with a particular embodiment of the present disclosure, connection means can additionally be fastened to the cross-brace for the direct reception of counter-weight plates for forming a counter-weight arrangement attached to the derrick boom. These connection means can be mandrels such as those described in DE 20 2004 009 497 U1. Exactly just so many counter-weight plates are advantageously installed into the counter-weight arrangement that the crane reliably just does not tilt to the rear with a boom system which is luffed sufficiently for the travel position.

In accordance with another advantageous aspect of the present disclosure, placement feet are arranged at the cross-brace on which the cross-brace can be placed, in particular also during transport.

To increase the ballast, the auxiliary crane standing on the ballast base plate can additionally itself receive a ballast and can, if required, additionally still receive a load likewise acting as ballast at the crane hook.

Further features, details and advantages of the present disclosure will be explained in more detail with reference to embodiments shown in the figures.

DETAILED DESCRIPTION

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
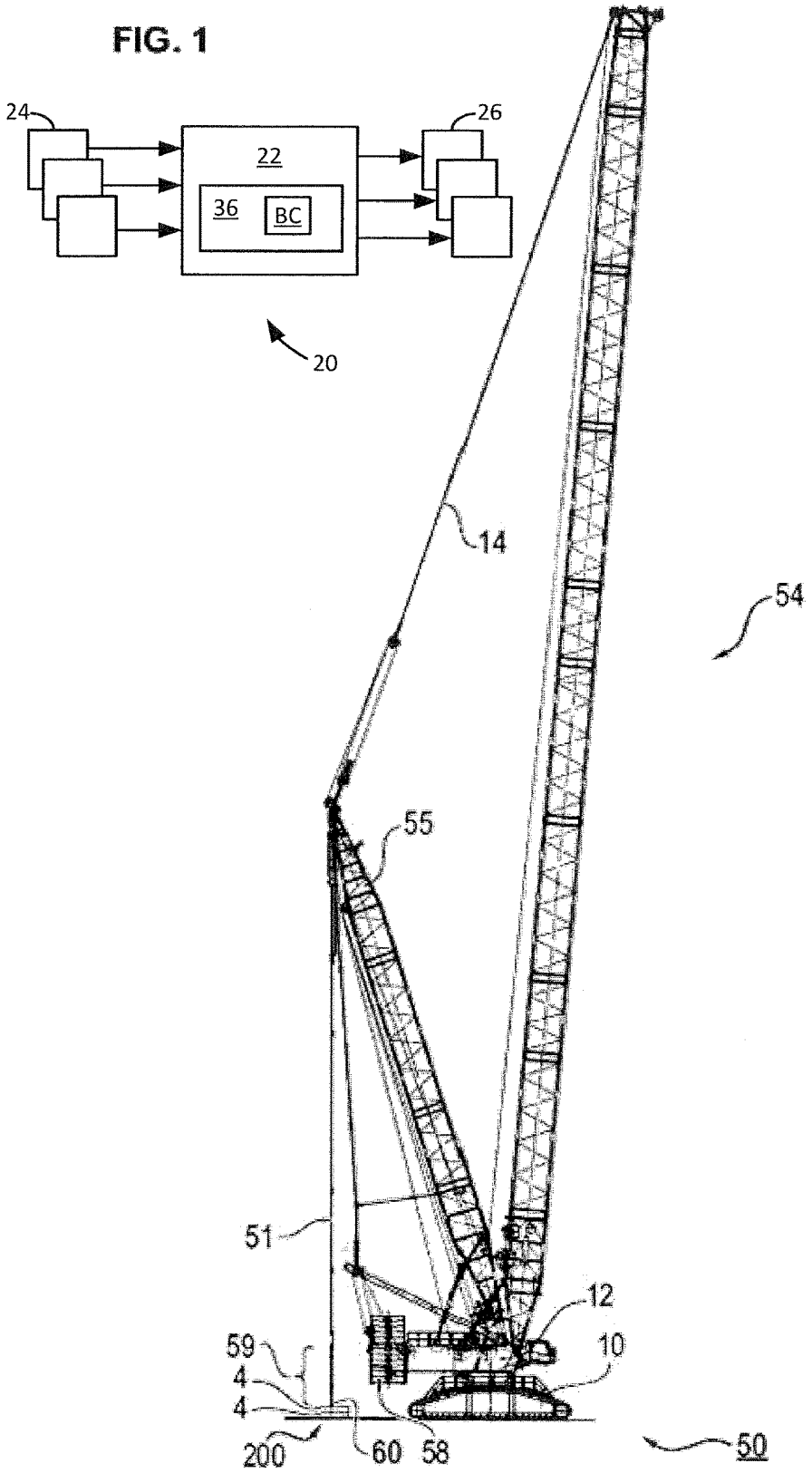
FIG. 1 shows a side view of the crane in accordance with the present disclosure in a representation with a largely erected boom system.

As shown in FIG. 1, crane 50 has an undercarriage 10, the undercarriage 10 having a chassis which is designed as a crawler chassis in the drawn embodiment and comprises two crawler tracks arranged at the left and the right. A superstructure 12 rotatably supported about an upright, vertical axis of rotation is arranged on the undercarriage 10. The superstructure 12 carries a main boom 54 which is called a boom system within the framework of the present disclosure and can thus comprise all customary configurations of booms. This boom 54 is connected in an articulated manner to the superstructure 12 about a horizontal luffing axis and has a hoist rope, not shown, in a customary manner.

At the rear side of the superstructure 12 opposite the articulated connection point of the boom 54, the former carries an operating/superstructure ballast 58 which counteracts the tilting torque induced by the boom 54 or by a load suspended thereon.

The rearwardly directed derrick boom 55 is mounted behind the boom system 54, with the boom system 54 or the main boom head being guyed in a conventional manner via the adjustable guying 14 at the derrick boom 55.

It is necessary on the raising of very heavy loads to guy the derrick boom 55 via an additional derrick ballast. As a rule, a derrick ballast is used for this purpose which is suspended above the ground and which is here shown as a constant ballast 200 (alternatively referred to herein as a counter-weight arrangement 200). Unlike the prior art, the crane 50 in accordance with the present disclosure provides an innovative solution approach for the ballast loading on the derrick boom 55, in particular during the assembly of the boom system 54, where particularly high counter-torques have to be generated.

Figure 2:
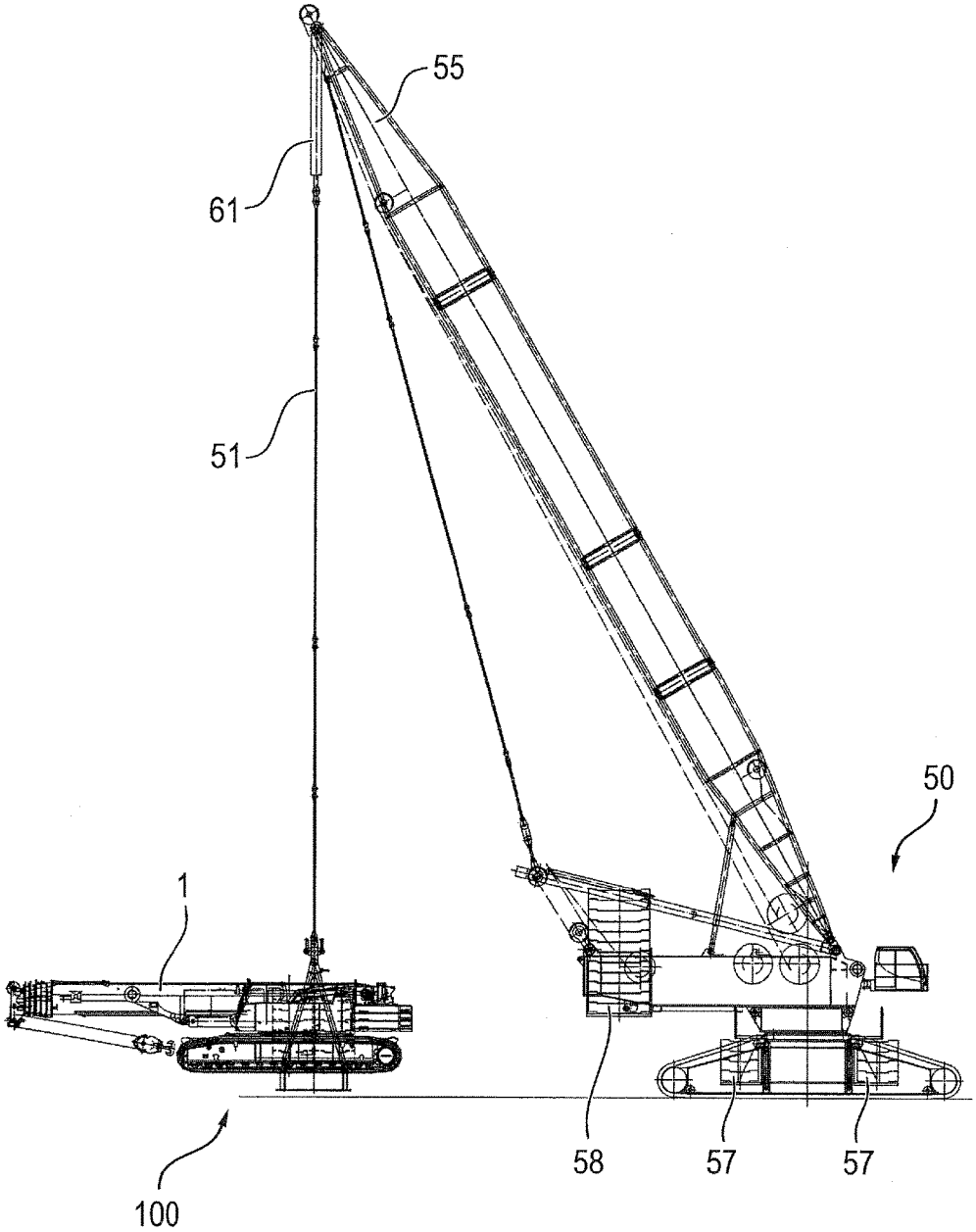
FIG. 2 shows a partial side view of the crane in accordance with the present disclosure with a fastened auxiliary crane in a different embodiment, with the boom system to be erected not being shown.
Figure 3:
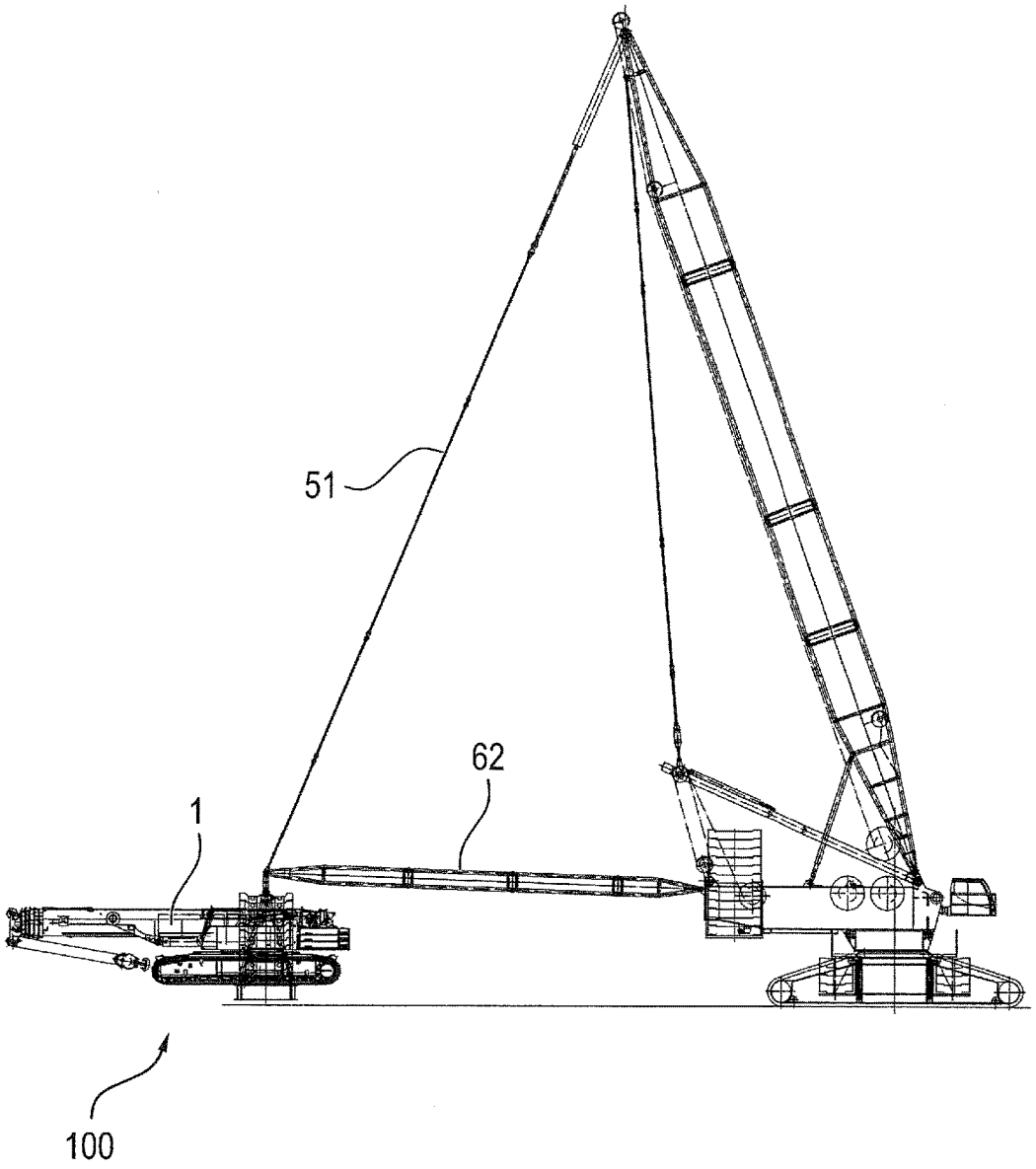
FIG. 3 shows a partial side view of the crane in accordance with the present disclosure.

This innovative solution approach for the ballast loading, in particular during the erection of the boom system 54, in particular results from the configurations shown in FIGS. 2 and 3. For reasons of space, the boom system 54, which is still lying on the ground here and still has to be erected, is not shown in these two representations.

Crane 50 further includes a crane control system 20, which is schematically shown in FIG. 1. Crane control system 20 includes a control unit 22, sensors 24, and actuators 26. Control unit 22 includes a processor 34 and non-transitory memory 36, the non-transitory memory having instructions stored therein for carrying out the various control actions described herein, including control actions associated with the method shown in FIG. 12. The sensors 24 represent the various sensors and/or detection devices described herein, such as the inclination sensor and sensor device discussed below. Sensors 24 further may include devices (e.g., display devices, joysticks, etc.) which receive input from an operator of the crane and send signals to the control unit responsive to the operator input. Control unit 22 receives signals from the various sensors 24 and employs the various actuators 26 to adjust operation of the crane (and optionally, of associated components such as the auxiliary crane), based on the received signals and the instructions stored in the non-transitory memory 36.

A respective ballast apparatus 100 with a high counter-weight as derrick ballast is provided in FIGS. 2 and 3. The design of the ballast apparatus/derrick ballast 100 is further shown in FIGS. 4 to 6 and additionally in the detailed representations shown in FIGS. 7 to 9. An auxiliary crane 1, whose total weight is part of the derrick ballast, is an element of this ballast apparatus 100. In some examples, auxiliary crane 1 may include its own control system, which may include a control unit including a processor and non-transitory memory with instructions stored therein for performing control actions related to the auxiliary crane (e.g., instructions to send a signal to one or more actuators to drive/travel the auxiliary crane), for example in response to input from an operator of the auxiliary crane. In other examples, the auxiliary crane may be controlled remotely via control system 20 of crane 50; e.g., the non-transitory memory of control system 20 may included instructions stored therein for performing control actions related to the auxiliary crane (e.g., instructions to send a signal to one or more actuators to drive/travel the auxiliary crane). The auxiliary crane 1 such as can be used in the present disclosure may have a mass of approximately 180 t, for example. The transportation of 180 t counter-weight to the construction site can thus be dispensed with on the use of the auxiliary crane. So that the mass can be used fast, the auxiliary crane 1 can advantageously drive independently over a ramp 2 (cf. FIG. 6) onto a ballast base plate 3. A further connection between the auxiliary crane 1 itself and the crane 50 is, unlike the previous solution from the prior art, actually not provided here. That is, there is no direct physical or mechanical connection or coupling between the auxiliary crane itself and the crane itself.

Figure 4:
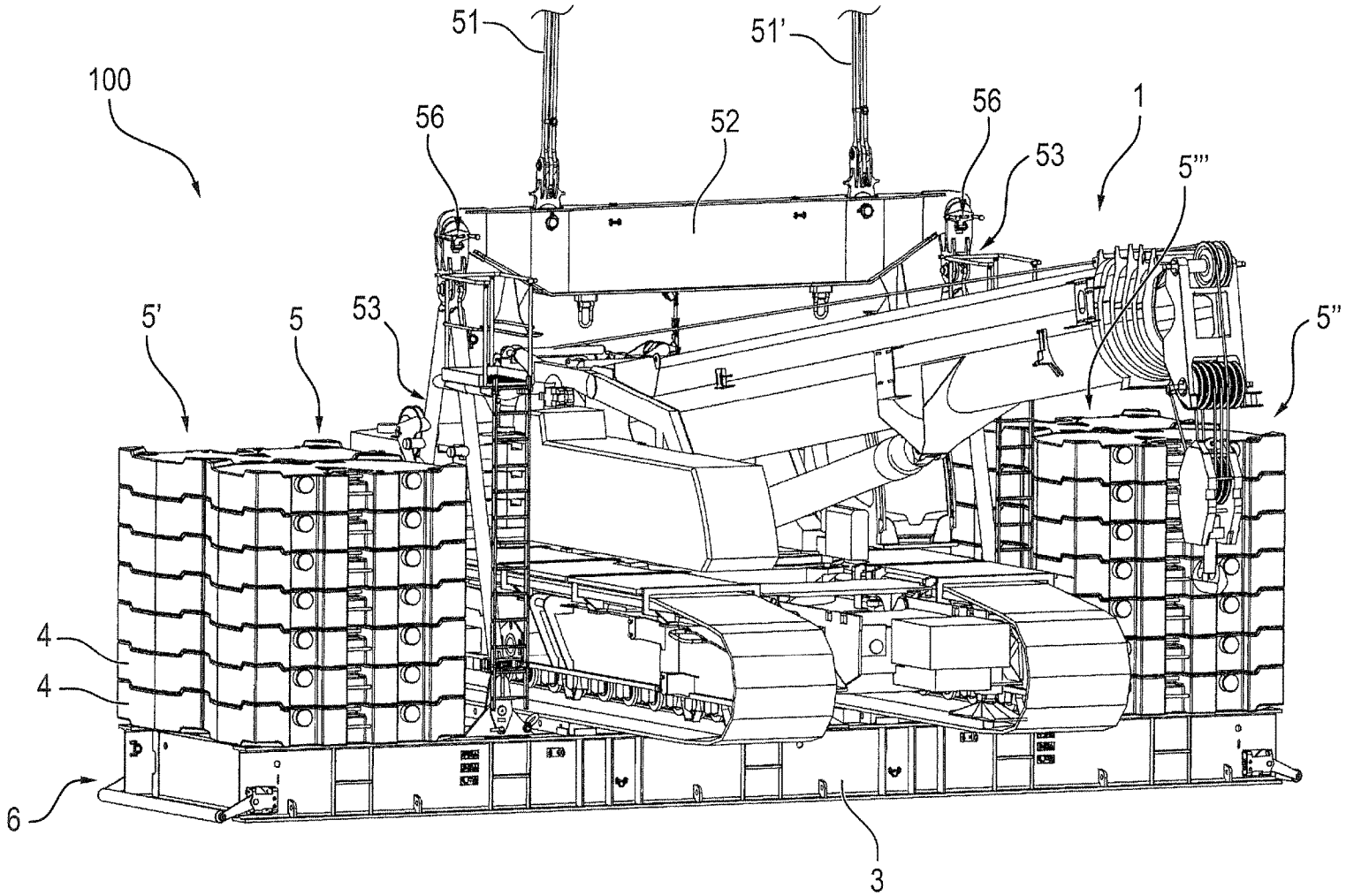
FIG. 4 shows a perspective representation of an embodiment variant of the derrick ballast.
Figure 5:
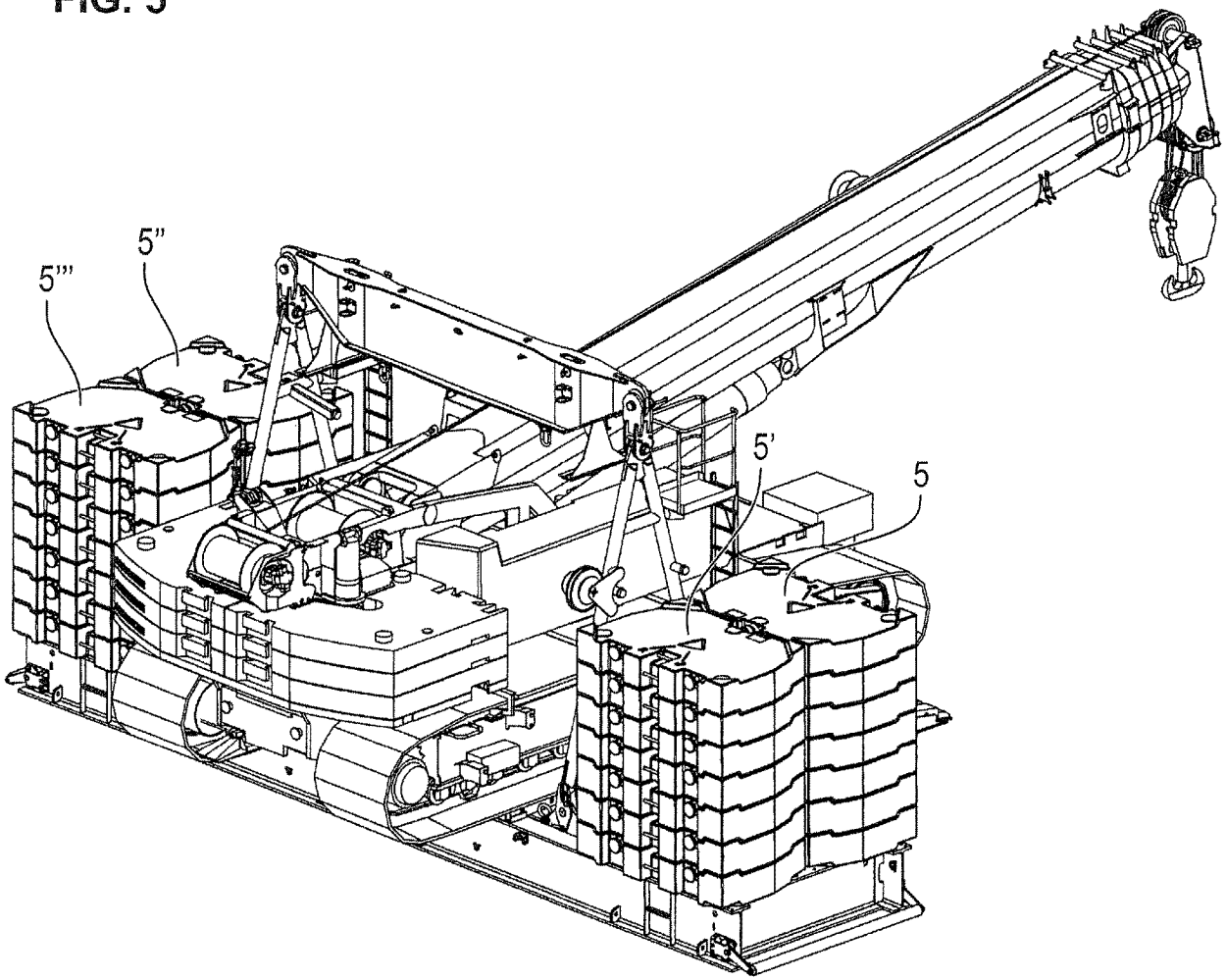
FIG. 5 shows another perspective representation of the derrick ballast in accordance with FIG. 4.
Figure 6:
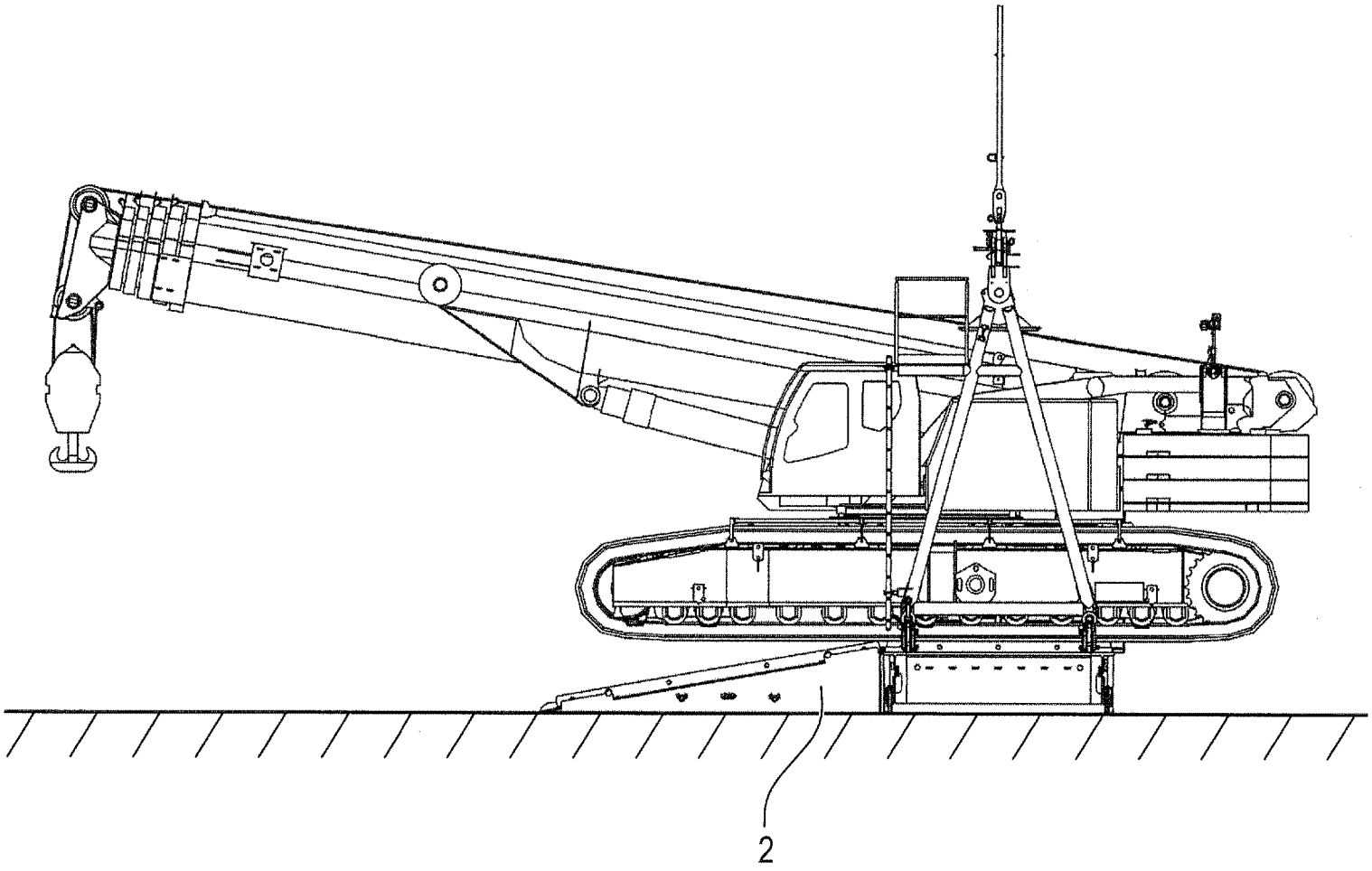
FIG. 6 shows a lateral representation of the derrick ballast in accordance with FIGS. 4 and 5.
Figure 7:
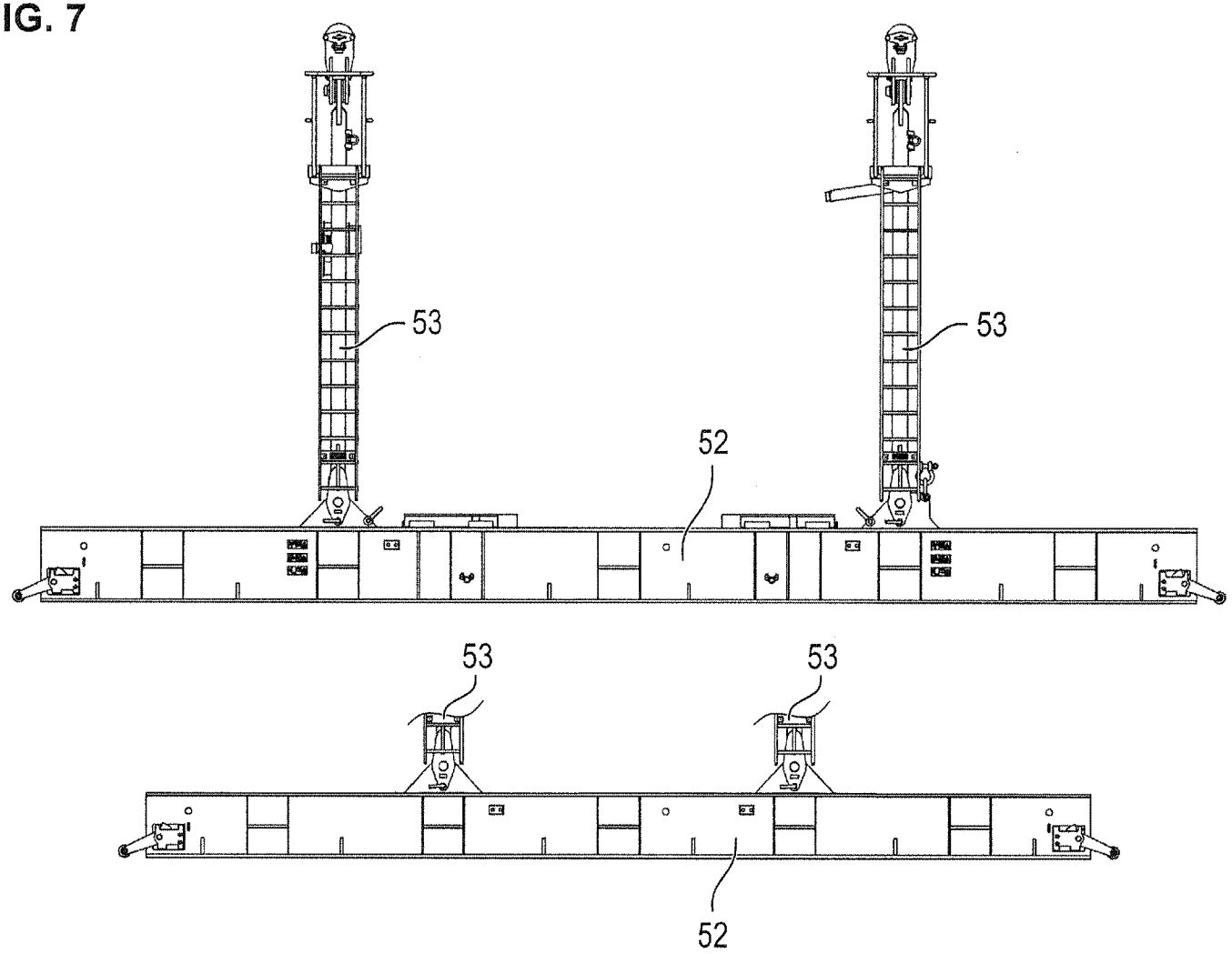
FIG. 7 shows details of the derrick ballast.

In addition to the auxiliary crane 1, further space can be provided on the ballast base plate to stack up further ballast, in particular further counter-weight plates 4. The counter-weight plates 4 can, as shown in FIG. 4, be distributed over four counter-weight stacks 5, 5', 5", 5'''. A sensor device 6 can be provided at the ballast base plate 3 to determine the complete raising of the ballast base plate from the ground and to forward it to the control unit 22 of the crane 50. For example, control unit 22 may receive a signal from sensor device 6 indicating the extent to which the ballast base plate is raised from the ground.

The ballast apparatus 100 is connected to the derrick boom 55 via parallel sections 51, 51' of stay poles. The spacing of the sections is predefined within certain limits by the width of the derrick boom 55. This spacing is substantially smaller than the width of the auxiliary crane 1. A cross-brace 52 is provided to be able to reliably establish the connection. As shown, the cross-brace may have a trapezoidal shape. This cross-brace connects the poles 51, 51' and corresponding connection blocks 53 are provided which connect the cross-brace 52 to the ballast base plate 3. The connection blocks 53 and the cross-brace 52, as shown in FIG. 4, form a gate into/through which the auxiliary crane 1 can drive. For example, the auxiliary crane can drive through a hollow space formed below the cross-brace and between the connection blocks.

As shown in FIG. 2, the stay poles 51, 51' are adjoined by length-variable cylinder arrangements 61 which introduce the force into the derrick boom 55. If there is no synchronization of these cylinders 61, the cross-brace 52 is in contact, as is shown, for example in FIG. 9. If the synchronization difference is greater than e.g. 1000 mm, which may be determined via an inclination sensor, which may be one of the sensors 24 schematically shown in FIG. 1, a corresponding compensation can take place, if required, via the crane control system in that the cylinders 61 are correspondingly controlled. For example, control unit 22 may receive a signal from the inclination sensor indicating the sensed synchronization distance, and in response to this signal, control unit 22 may send a signal to actuators of the cylinders 61 (e.g., actuators 26 shown in FIG. 1) to compensate for the synchronization difference. Pin connections 56 are provided between the cross-brace 32 and the connection blocks 53 carrying the ballast base plate 3. A corresponding pivotability admittedly hereby results. However, the ballast base plate 3 is as a rule aligned in parallel with the cross-brace 52. For example, in a normal operating position, a horizontal plane in which the ballast base plate is arranged is parallel to a horizontal plane in which the cross-brace is arranged.

To increase the mass of the auxiliary crane 1, it can be equipped with a central ballast 57. An additional ballast would also be possible. An additional load can furthermore be received at the hook of the auxiliary crane 1, as is not shown here, to increase the counter-torque. The total mass of, for example, 480 t can also be reached without additional ballast or additional load at the hook. This can therefore be increased even further by a further reception of ballast and of a hook load.

The crane 50 can erect its long boom system 54 with the correspondingly large mass of the ballast apparatus 100. The erection process is monitored by the crane control system, with reference to a suitable erection payload table stored in the non-transitory memory 36 of the crane control system 20. If the boom is erected, the crane can operate with a substantially smaller counter-weight arrangement 200 and can, for example, carry out the lifts required for the setting up of a wind power station. A plurality of wind power stations frequently have to be assembled on one construction site. The crane could also travel from installation site to installation side with an erected boom system 54.

With the crane 50 here, the torque of the erected boom system 54 is not sufficient to raise the large mass of the ballast apparatus 100 from the ground. In order nevertheless to be able to travel or rotate the main crane 50, releasable connections (e.g., quick-release connections which do not require screwing in/out or other labor intensive processes for release), such as pin connections 56, are provided between the cross-brace 52 and the connection blocks 53. The pin connections 56 can be released after the erection of the boom system 54. The main crane 50 is thus free from the ballast apparatus and can be traveled or rotated.

To achieve the required payload, for example for the mounting of the elements of a wind power station, a maximum ballast application of the main crane 50 with central ballast 57 and superstructure ballast 58 is also not sufficient. A further derrick ballast is therefore necessary. This derrick ballast can be provided by a counter-weight arrangement 200 such as is shown in FIG. 1 or in FIGS. 10 and 11.

Figure 10:
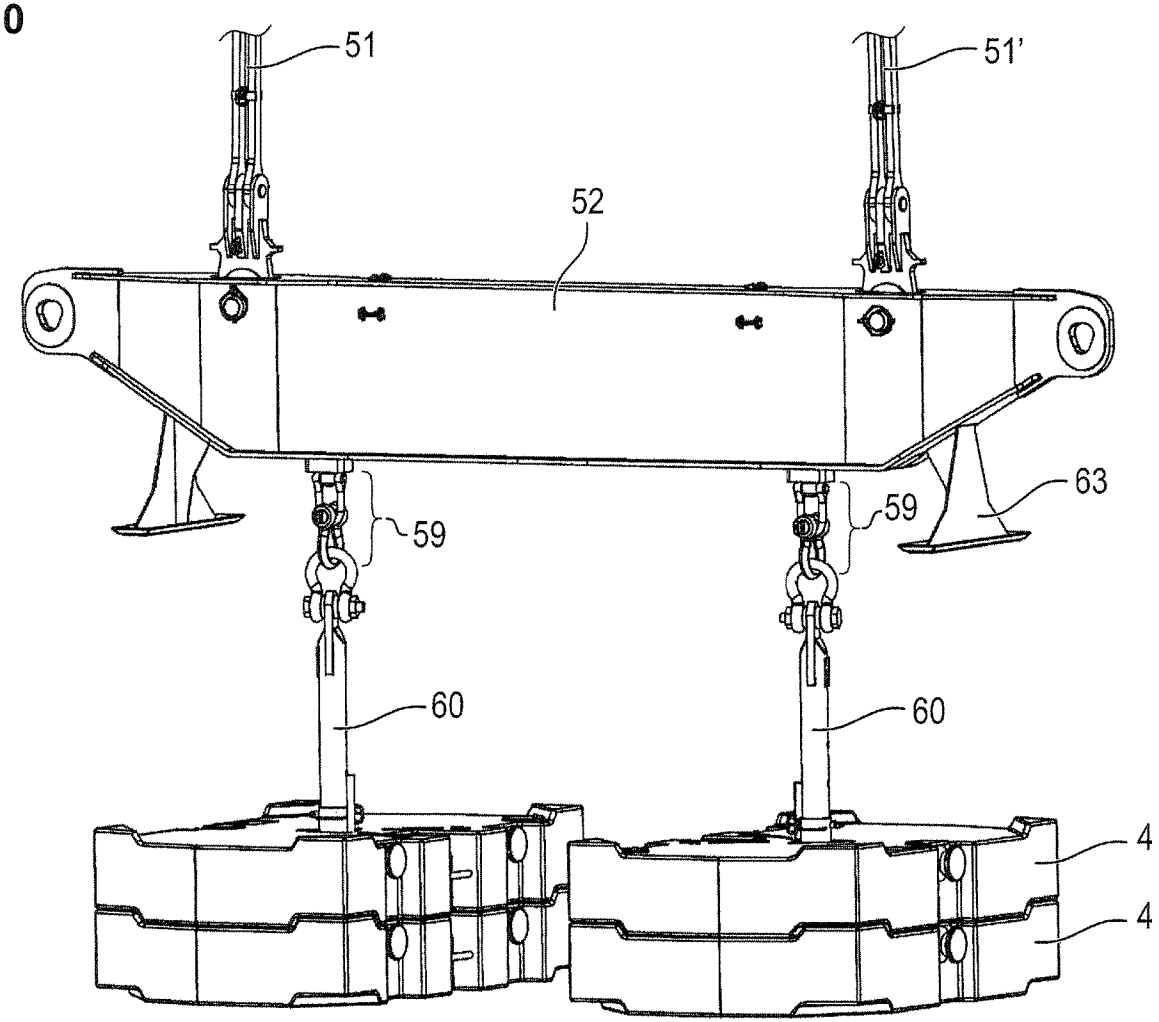
FIG. 10 shows an exemplary configuration of the derrick ballast disclosure.

A first embodiment variant of this counter-weight arrangement 200, which is also called a constant ballast, results from FIG. 10. A mandrel 60, known per se, is here introduced via corresponding connection apparatuses 59 directly at the cross-brace 52 from which the ballast apparatus 100 was decoupled. This mandrel is described in the German utility model 20 2004 009 497 U of the same applicant and has been used for many years for taking up counter-weight plates. Each mandrel 60 can carry one or more counter-weight plates 4. Exactly so many counter-weight plates 4 are advantageously installed in the counter-weight plate arrangement 200 such that the crane reliably just does not tilt to the rear with the boom system 54 luffed sufficiently for the travel movement. For this purpose, a special payload table BC stored in the non-transitory memory 36 of the control unit 22 can serve as a basis for actions performed by the crane control system in order to achieve a secure state at all times. For example, based on the payload table BC, the crane control system may increase the payload values (e.g., indicate to a crane operator via a display device that a larger payload may be handled by the crane safely) without transferring the ballast of the suspended ballast pallet. The main crane 50 could, for example, after the mandrels 60 have been attached, move them over the ballast apparatus 100 and independently take up the required respective two counter-weight plates 4, such as are shown in FIG. 10. No complex restacking of the ballast apparatus 100 would be necessary for this purpose in accordance with the present disclosure.

Figure 11:
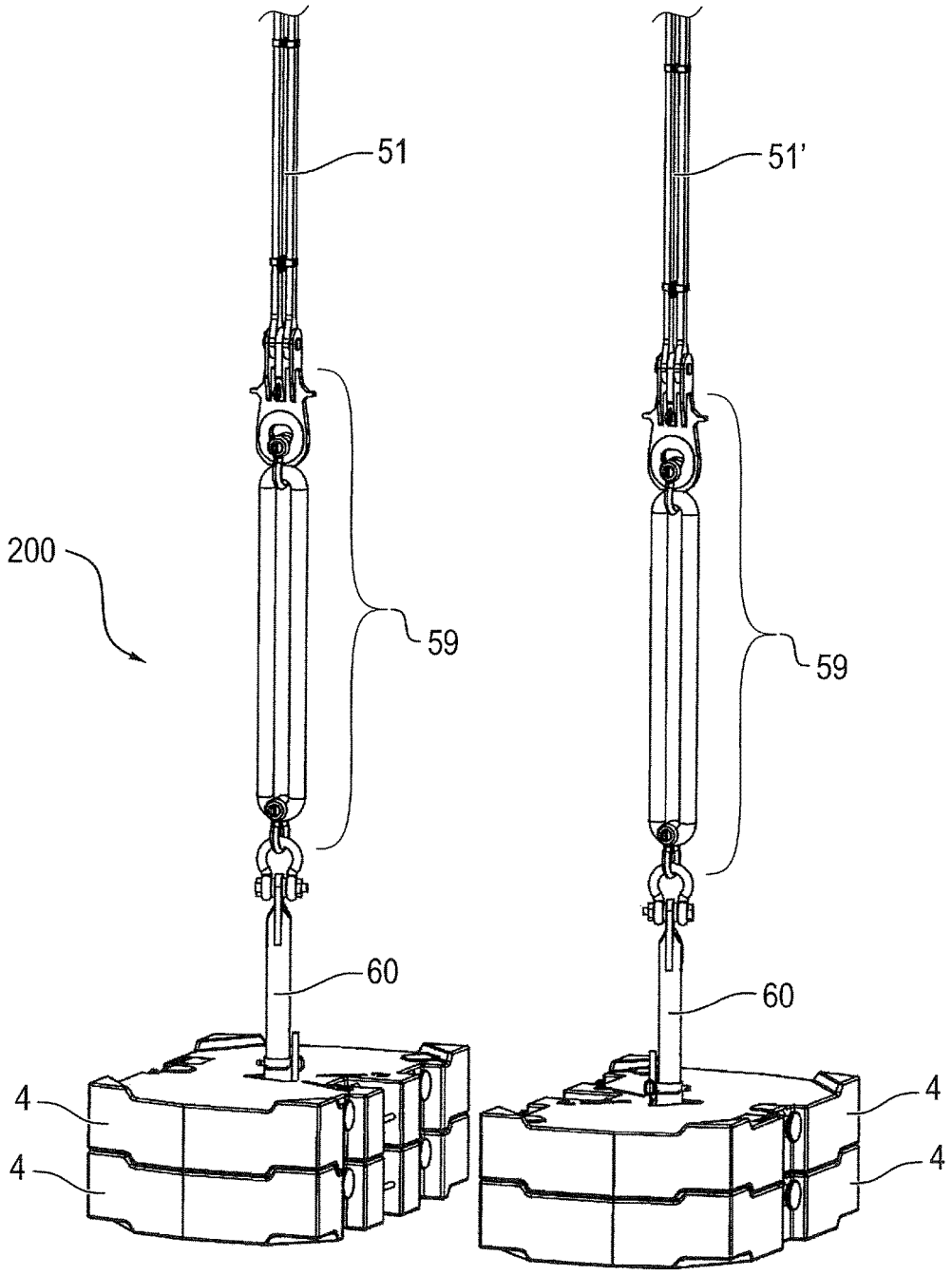
FIG. 11 shows a different exemplary configuration of the derrick ballast.

In accordance with an alternative embodiment, as is shown in FIG. 11 and such as can also be seen from FIG. 1, the cross-brace 52 may be omitted from the ballast apparatus 100. The mandrels 60 are then attached directly to the stay rods 51, 51' using the corresponding connection apparatuses 59. In this embodiment, then, the gate through which the auxiliary crane is formed by the connection blocks 53 alone.

It is advantageous that a monitoring of the counter-weight arrangement 200 for "raised from the ground" (e.g., monitoring performed by the crane control system to ensure that the counter-weight arrangement 200 is raised from the ground) can be dispensed with. Also, when being placed down onto the ground, the relatively low weight cannot damage the crane when traveling or rotating. A ballast which is not placed onto the ground is also not considered as suspended ballast in the USA, for example, and is thus also not covered by the associated regulations. In accordance with the payload table BC, namely only those luffing positions of the boom systems 54 can be traveled to which ensure a constant raising of the counter-weight arrangement.

It is further idea of the present disclosure that the variable effective radius of the counter-weight plates 4 is changed as follows: For instance, a superstructure ballast 58 required for the operation of the crane 50 can be removed during erection and be used in the ballast apparatus 100. This substantially increases the counter-torque and work can be carried out with a smaller number of counter-weight plates 4. The proportion of the transportation costs for transporting in and away the counter-weight plates to and from the construction site can thereby be reduced.

Figure 8:
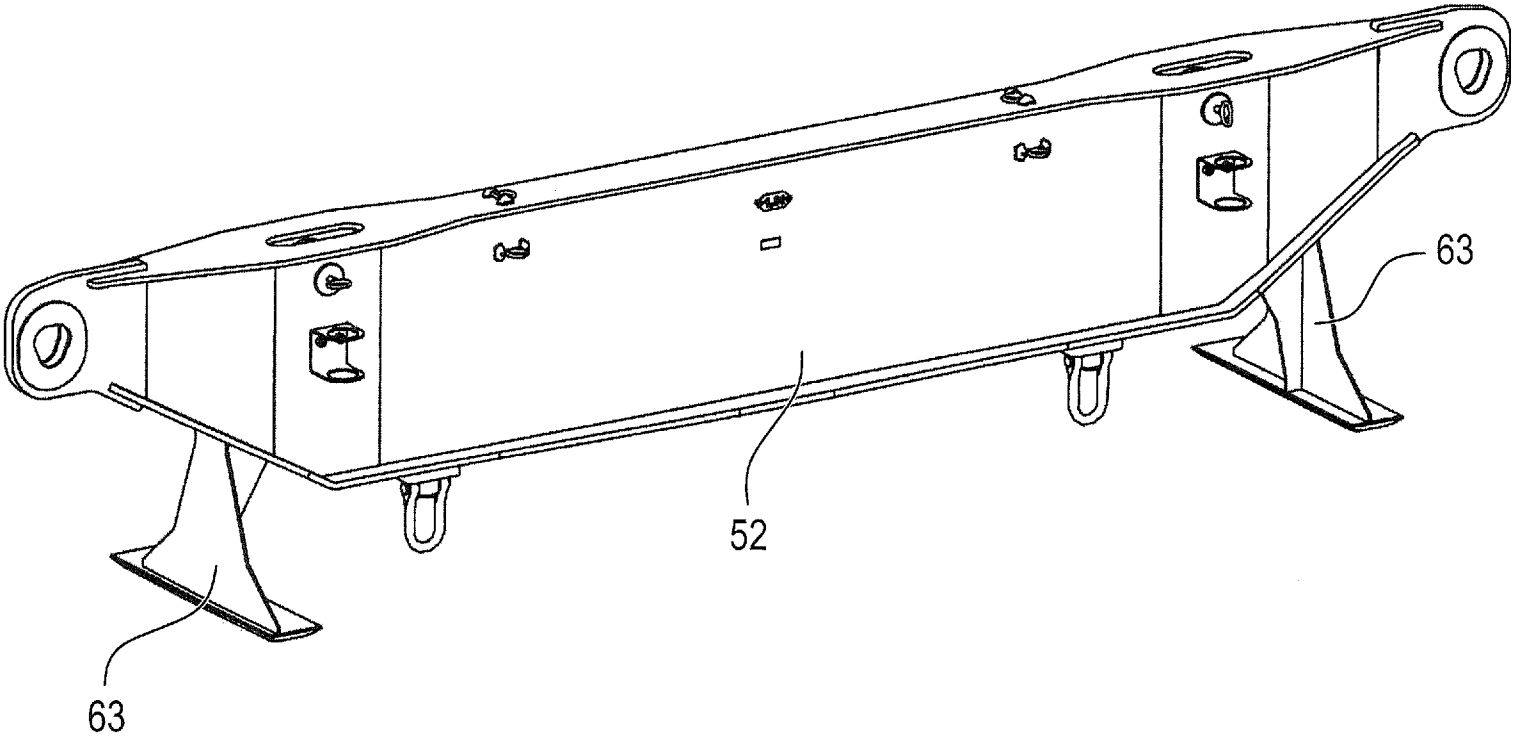
FIG. 8 shows details of the derrick ballast.
Figure 9:
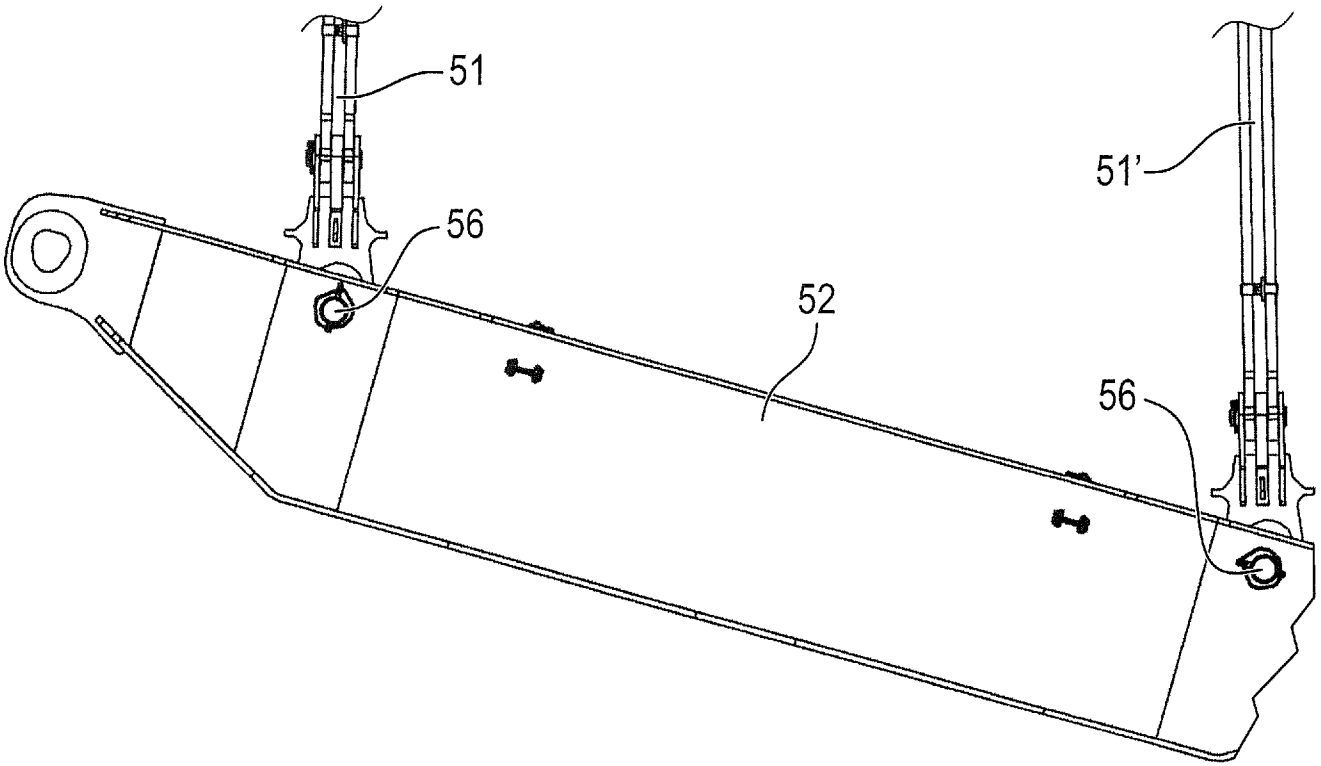
FIG. 9 shows details of the derrick ballast.

As is shown in FIG. 8, placement feet 63 are provided at the cross-brace 52. The cross-brace 52 can be placed down on them.

In the embodiment variant shown in FIG. 3, a spacing apparatus in the form of a guide frame 62 is additionally used to allow a larger ballast torque. It is arranged between the ballast base plate 3 and the superstructure 12 of the crane 50.

Figure 12:
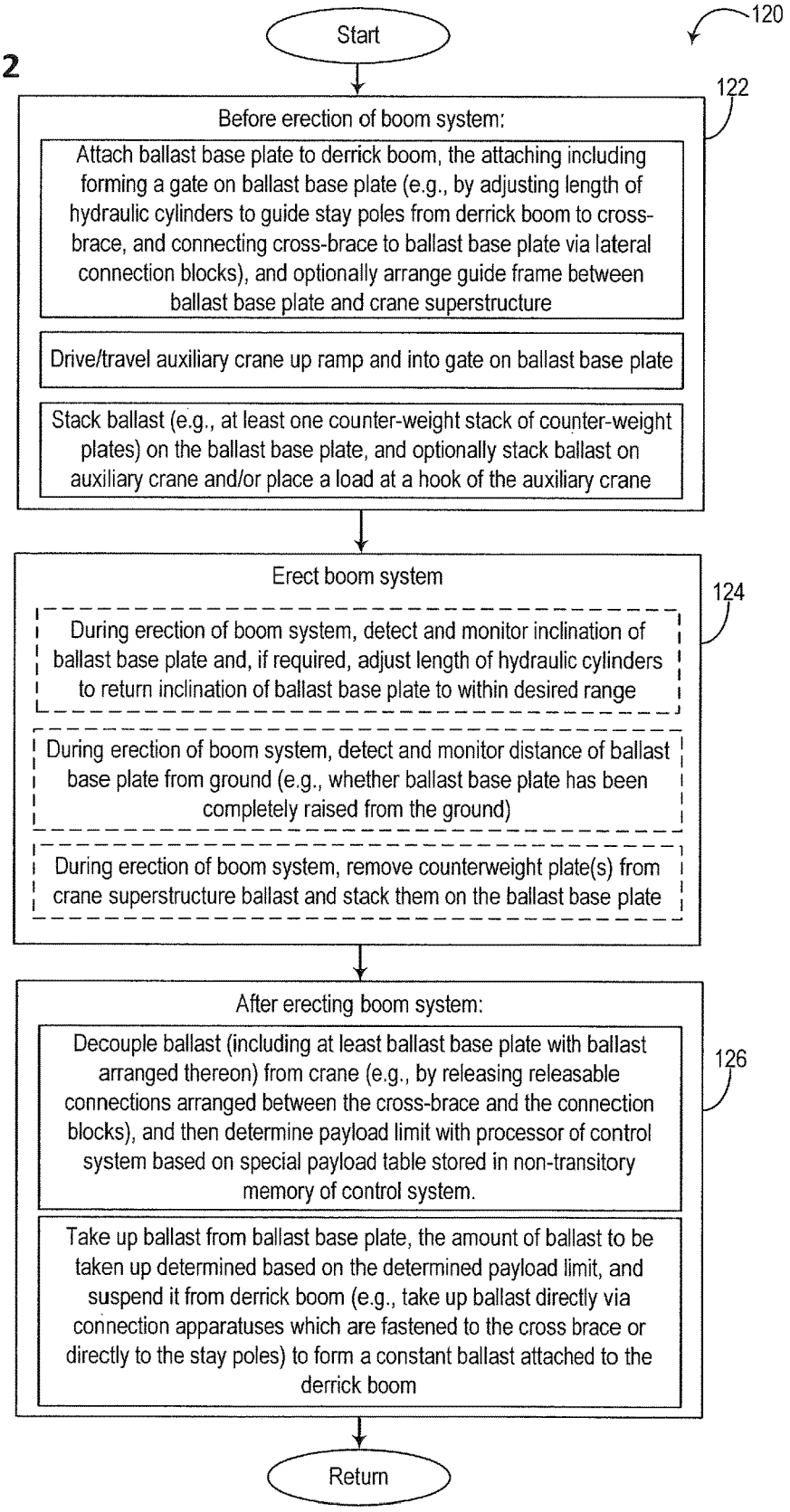
FIG. 12 shows a flow chart of a method for erecting a boom system of a crane in accordance with the present disclosure.

FIG. 12 shows a flow chart of a method 120 for erecting a boom system of a crane, e.g., the crane shown in FIGS. 1-12. Instructions for carrying out method 120 may be stored in non-transitory memory of a control system, such as non-transitory memory 36 of control system 20 shown in FIG. 1. Further, method 120 may be executed by a processor of the control system (e.g., processor 22 of control system 20 shown in FIG. 1). Additionally, method 120 may present a method for operating the crane and ballast apparatus shown in FIGS. 1-11. For example, the control system may be in communication with one or more actuators (e.g., actuators 26), which may each be coupled to various movable components of the crane.

At 122, method 120 includes performing several actions before erection of the boom system. These actions include attaching the ballast base plate to the derrick boom. For example, the attaching may include forming a gate on ballast base plate (e.g., by adjusting length of hydraulic cylinders to guide stay poles from derrick boom to cross-brace, and connecting cross-brace to ballast base plate via lateral connection blocks). Optionally, a guide frame may be arranged between the ballast base plate and crane superstructure to provide spacing therebetween. After attaching the ballast base plate to the derrick boom, the method includes driving/traveling the auxiliary crane up a ramp and into the gate formed on ballast base plate, such that the auxiliary crane stands on the ballast plate and itself serves as ballast. Subsequently, the method includes stacking ballast (e.g., at least one counter-weight stack of counter-weight plates) on the ballast base plate, and optionally also stacking ballast on the auxiliary crane and/or placing a load at a hook of the auxiliary crane.

After 122, method 120 proceeds to 124 to erect the boom system. During erection of the boom system, the method optionally includes detecting and monitoring an inclination of the ballast base plate (e.g., an angle at which the ballast base plate is raised relative to the surface of the ground on which the ballast base plate stands) and, if required, adjusting a length of hydraulic cylinders (which are interposed between the derrick boom and the stay poles) to return the inclination of the ballast base plate to within a desired range (e.g., to reduce the inclination of the ballast base plate). Further, during erection of the boom system, the method optionally includes detecting and monitoring a distance of the ballast base plate from the ground (e.g., whether the ballast base plate has been completely raised from the ground). Furthermore, during erection of the boom system (or alternatively, before erection of the boom system), the method optionally includes removing one or more counter-weight plates from the crane superstructure ballast and stacking them on the ballast base plate.

After the boom system has been erected, method 120 proceeds to 126. At 126, method 120 includes decoupling the ballast (including at least the ballast base plate with ballast arranged thereon) from the crane (e.g., by releasing releasable connections arranged between the cross-brace and the connection blocks). At 126, method 120 further includes determining a payload limit with a processor of the control system based on a special payload table (e.g., special payload table BC) stored in the non-transitory memory of the control system. Subsequently, at 126, the method includes taking up ballast from the ballast base plate, the amount of ballast to be taken up determined based on the determined payload limit, and suspending the taken-up ballast from derrick boom. The ballast may be taken up/suspended either via connection apparatuses which are fastened to the cross brace (as shown in FIG. 10), or via connection apparatuses which are directly attached to the stay poles (as shown in FIG. 11), to thereby form a constant ballast attached to the derrick boom. After 126, method 120 returns.

The invention claimed is:

1. A method of operating a crane having a travelable undercarriage, a superstructure rotatably supported thereon, a luffable boom system arranged thereat, and a derrick boom, wherein an auxiliary crane forms part of a ballast apparatus, comprising:

traveling the auxiliary crane onto a ballast base plate attached to the derrick boom; and then erecting the boom system while the auxiliary crane is disposed on the ballast base plate, wherein the auxiliary crane forms a majority of the ballast apparatus.

2. The method in accordance with claim 1, wherein, in addition to the auxiliary crane, the ballast apparatus comprises at least one stack of counter-weight plates stacked on the ballast base plate.

3. The method in accordance with claim 2, wherein traveling the auxiliary crane onto the ballast base plate further comprises traveling the auxiliary crane up a ramp and then into a gate formed on the ballast base plate, the gate formed by a cross-brace and lateral connection blocks, the lateral connection blocks connecting the cross-brace with the ballast base plate, wherein at least one guying is arranged between the derrick boom and the ballast base plate, the at least one guying comprising stay poles guided from the derrick boom, each stay pole adjoined to a respective length-variable cylinder arrangement, the stay poles and cylinder arrangements connecting the derrick boom with the cross-brace.

4. The method in accordance with claim 3, further comprising, with a control system, detecting and monitoring an inclination of the ballast base plate based on a signal from at least one inclination sensor, and, if required, controlling the cylinder arrangements to return the inclination of the ballast base plate into a desired range.

5. The method in accordance with claim 3, wherein the ballast base plate forms part of the ballast apparatus, the method further comprising decoupling the ballast apparatus from the crane via releasable connections arranged between the cross-brace and the connection blocks, and then traveling or rotating the crane.

6. The method in accordance with claim 5, further comprising, after decoupling the ballast apparatus from the crane, taking up and suspending one or more of the counter-weight plates, either from the cross-brace via connection apparatuses while the cross-brace is still attached to the derrick boom, or directly from the stay poles via the connection apparatuses, thereby forming a constant ballast attached to the derrick boom.

7. The method in accordance with claim 6, further comprising directly placing the counter-weight plates on the decoupled ballast base plate of the ballast apparatus via the connection apparatuses.

8. The method in accordance with claim 6, wherein a special payload table is stored in non-transitory memory of a control system of the crane, the method further comprising, after decoupling the ballast apparatus from the crane and before the constant ballast is attached to the derrick boom, determining a payload limit with a processor of the control system based on the special payload table, and then taking up and suspending an amount of the counter-weight plates which is based on the payload limit to form the constant ballast.

9. The method in accordance with claim 2, further comprising removing counter-weight plates from the superstructure and stacking the counter-weight plates on the ballast base plate to increase torque while erecting the boom system.

10. The method in accordance with claim 1, further comprising, with a control system, determining whether the ballast base plate has been completely raised from the ground based on a signal from at least one sensor device.

11. The method in accordance with claim 1, wherein a guide frame is arranged between the ballast base plate and the superstructure, the guide frame spacing the ballast base plate from the superstructure to thereby increase a torque of the derrick boom.

12. A crane, comprising:

a travelable undercarriage having a superstructure rotatably supported thereon and a luffable boom system arranged thereon;

a derrick boom;

a control system; and a ballast apparatus comprising at least a ballast base plate, wherein during erection of the boom system, an auxiliary crane is received on the ballast base plate within a gate formed on the ballast base plate, the gate formed by a cross-brace and lateral connection blocks, the lateral connection blocks connecting the cross-brace with the ballast base plate, the cross-brace further connected to the derrick boom via stay poles.

13. The crane in accordance with claim 12, wherein, in addition to the stay poles, respective length-variable elements in the form of hydraulic cylinder arrangements are provided between the derrick boom and the cross-brace.

14. The crane in accordance with claim 12, wherein, during erection of the boom system, in addition to the auxiliary crane, the ballast apparatus further comprises at least one counter-weight stack comprising counter-weight plates stacked on the ballast base plate.

15. The crane in accordance with claim 12, wherein releasable connections are arranged between the cross-brace and the lateral connection blocks.

16. The crane in accordance with claim 14, wherein, after erection of the boom system and while the ballast apparatus is decoupled from the crane, connection apparatuses are fastened to the cross-brace, the connection apparatuses directly receiving one or more of the counter-weight plates, thereby forming a counter-weight arrangement attached to the derrick boom.

17. The crane in accordance with claim 12, wherein placement feet are arranged at the cross-brace.

18. The crane in accordance with claim 12, wherein, during erection of the boom system, the auxiliary crane arranged on the ballast base plate additionally receives ballast and/or receives a load at a crane hook thereof.

* * * * *